US005934911A

United States Patent [19]

Stout et al.

[11] Patent Number: 5,934,911

[45] Date of Patent: Aug. 10, 1999

[54] WATERPROOF QUICK DISCONNECT SLIP RING DEVICE

[75] Inventors: Brian Stout, Panama City Beach; Joseph Jordan, Panama City; Robert Peebles, Lynn Haven, all of Fla.

[73] Assignee: The United States of America as represented by the Secretary of the Navy, Washington, D.C.

[21] Appl. No.: 08/837,170

[22] Filed: Apr. 14, 1997

[51] Int. Cl.[6] ..... H01R 39/00

[52] U.S. Cl. ..... 439/21; 439/271; 439/348

[58] Field of Search ..... 439/21, 22, 271, 439/348, 27, 289

[56] References Cited

U.S. PATENT DOCUMENTS

| | | | |
|---|---|---|---|
| 4,521,064 | 6/1985 | Knapp et al. | 439/271 |
| 4,674,352 | 6/1987 | Mizuno et al. | 439/22 |
| 4,698,028 | 10/1987 | Caro et al. | 439/271 |
| 5,046,964 | 9/1991 | Welsh et al. | 439/271 |
| 5,730,625 | 3/1998 | Sikora | 439/271 |

*Primary Examiner*—Paula Bradley
*Assistant Examiner*—Katrina Davis
*Attorney, Agent, or Firm*—Harvey A. Gilbert; Donald G. Peck

[57] ABSTRACT

A waterproof quick disconnect slip ring device includes a female component attached to a rotating component, a male component attached to a stationary component and removably inserted into a cavity of the female component so as to permit relative rotation between the female and male components, and an annular dynamic seal provided between the female and male components so as to provide a dynamic water-tight seal therebetween as the female and male components rotate relative to one another. The female and male components respectively have first and second electrical conductor arrangements which are electrically coupled together and maintained in the electrical coupled relationship as the female and male components and the first and second electrical conductor arrangements therewith undergo rotation relative to one another. The slip ring device also includes an annular hub and a pair of end caps with annular static seals. The annular hub has a pair of spaced apart opposite end portions and a longitudinal opening extending therebetween with the female component being removably inserted into and secured to the annular hub. The end caps and annular static seals are applied respectively to outer end portions of the male component and annular hub so as to provide water-tight static seals at opposite ends of the slip ring device.

19 Claims, 2 Drawing Sheets

WATERPROOF QUICK DISCONNECT SLIP RING DEVICE

BACKGROUND OF THE INVENTION

1. Field of the Invention

The present invention generally relates to slip ring assemblies for rotating machines, such as electric winches, and, more particularly, is concerned with a waterproof quick disconnect slip ring device.

2. Description of the Prior Art

Slip rings have been used to transfer electrical power or signals between rotatable and stationary components for several years. Due to their broad range of applications, a variety of slip ring designs are known in the prior art. A typical slip ring design basically includes brushes attached on electrical contacts mounted on the stationary component and a metal ring mounted on the rotatable component so as to provide continuous electrical connection through the brushes to the contacts during rotation of the rotatable component relative to the stationary component.

An application where a suitable slip ring design is needed but not found in the prior art is one that would allow frequent routine maintenance on a rotatable underwater winch drum used for reeling in and paying out an underwater electrical cable. One prior art slip ring design for a winch drum provides circumferential rings that are secured to the exterior of an insulating disk. However, the slip ring must be removed to perform routine maintenance on the winch drum. The need to frequently remove the slip ring in order to conduct maintenance reduces the integrity of the slip ring seal, allowing leaks in the host system, resulting in a less reliable slip ring. Also, removing and replacing this type of slip ring is arduous and time consuming, which can become an expensive problem during testing and operations.

Lacking in any of the prior art slip ring designs is a reliable waterproof slip ring that also uses a quick disconnect feature allowing for quick and easy separation of the rotating component from the stationary component. This is because quick component separation typically requires that there be an electrical connector provided on each of the opposite sides of the slip ring. As with any electrical circuit, it is preferred to minimize the number of electrical connectors because they inherently decrease reliability. In addition, quite often it is impossible to find a relatively reliable underwater electrical connector that is small enough to satisfy a space constraint.

Consequently, a need still exists for an improved design for a slip ring which will overcome the drawbacks of the prior art without introducing new ones in their place.

SUMMARY OF THE INVENTION

The present invention provides a waterproof quick disconnect slip ring device designed to satisfy the aforementioned need. The slip ring device of the present invention combines improved electrical and waterproof reliability with the capability of quick and easy separation of a rotatable female component from a stationary male component of the slip ring device without the use of tools. This capability is extremely beneficial when maintenance must be conducted on either of the rotatable and stationary components.

In addition, the slip ring device accomplishes waterproofing by using only one dynamic O-ring seal with four static O-ring seals, as compared with many prior art submersible slip rings having multiple dynamic seals. The use of only one dynamic seal minimizes the potential number of leak paths and thereby improves reliability.

Accordingly, the present invention is directed to a waterproof quick disconnect slip ring device which comprises a female component having means for attaching it to one of a stationary component or a rotating component, a male component having means for attaching it to the other of the stationary component or the rotating components and being removably inserted into a cavity of the female component so as to permit relative rotation between the female and male components about a central longitudinal axis, and an annular dynamic seal provided between the female and male components so as to provide a dynamic water-tight seal therebetween as the female and male components undergo relative rotation about the central longitudinal axis.

The female component has a pair of spaced apart opposite end portions, the cavity extending therein from one of the end portions, and a plurality of longitudinal passageways laterally spaced apart and extending therein from the other of the end portions and merging into the cavity. The male component has a pair of spaced apart opposite end portions and a plurality of laterally spaced apart longitudinal channels defined between the opposite ends.

The slip ring device further comprises a plurality of first electrical conductor elements each disposed in one of the longitudinal passageways of the female component, a plurality of second electrical conductor elements each disposed in one of the longitudinal channels of the male component, and means in the female and male components for electrical coupling the first electrical conductor elements of the female component with the second electrical conductor elements of the male component to provide electrical circuit paths through the slip ring device regardless of the relative rotational positions of the female and male components with respective to one another as the female and male components and the first and second electrical conductor elements therewith undergo rotation relative to one another about the central longitudinal axis.

The slip ring device also comprises an annular hub having a pair of spaced apart opposite end portions and a longitudinal opening extending therebetween with the female component being removably inserted into and secured to the annular hub. The slip ring device further comprises a pair of end caps with annular static seals. The end caps and annular static seals are applied respectively to outer ones of the end portions of the male component and the annular hub so as to provide water-tight static seals at the opposite outer ends of the slip ring device.

More particularly, the plurality of longitudinal passageways of the female component includes at least one central longitudinal passageway extending along the central longitudinal axis and at least a pair of lateral longitudinal passageways displaced laterally the same distance from and extending parallel to the central longitudinal passageway. The plurality of longitudinal channels of the male component includes at least one central longitudinal channel extending along the central longitudinal axis and at least a pair of lateral longitudinal channels displaced laterally the same distance from and extending parallel to the central longitudinal channel. The central longitudinal passageway and channel are aligned with one another along the central longitudinal axis and the lateral longitudinal passageways and channels are displaced the same distance from the central longitudinal axis.

The electrical coupling means includes an annular recess defined in the male component at one of the end portions thereof that is inserted into the cavity in the female component and an annular electrical contact element disposed in the annular recess. The annular recess is aligned and merges with the lateral longitudinal channels in the male component and is aligned with the lateral longitudinal passageways in the female component. The annular electrical contact element provides the electrical coupling of lateral ones of the second electrical conductor elements disposed in the lateral longitudinal channels of the male component with lateral ones of the first electrical conductor elements disposed in the lateral longitudinal passageways of the female component. The electrical coupling means further includes a central recess defined in the male component at the one end portion thereof and a central electrical contact element disposed in the central recess. The central recess provides an extension of the central longitudinal channel in the male component and is aligned with the central longitudinal passageway in the female component. The central electrical contact element is attached to and provides an extension of a central one of the second electrical conductor elements disposed in the central longitudinal channel of the male component and thereby provides the electrical coupling between the central one of the second electrical conductor elements of the male component and a central one of the first electrical conductor elements of the female component. Also, the first electrical conductor elements of the female component respectively extend from the longitudinal passageways thereof at least for a short distance into the cavity thereof and are spring-mounted to the female component so as to be retractable away from the cavity upon insertion of the male component in the cavity of the female component and upon engagement of the first electrical conductor elements of the female component with the annular and central electrical contact elements of the male component.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
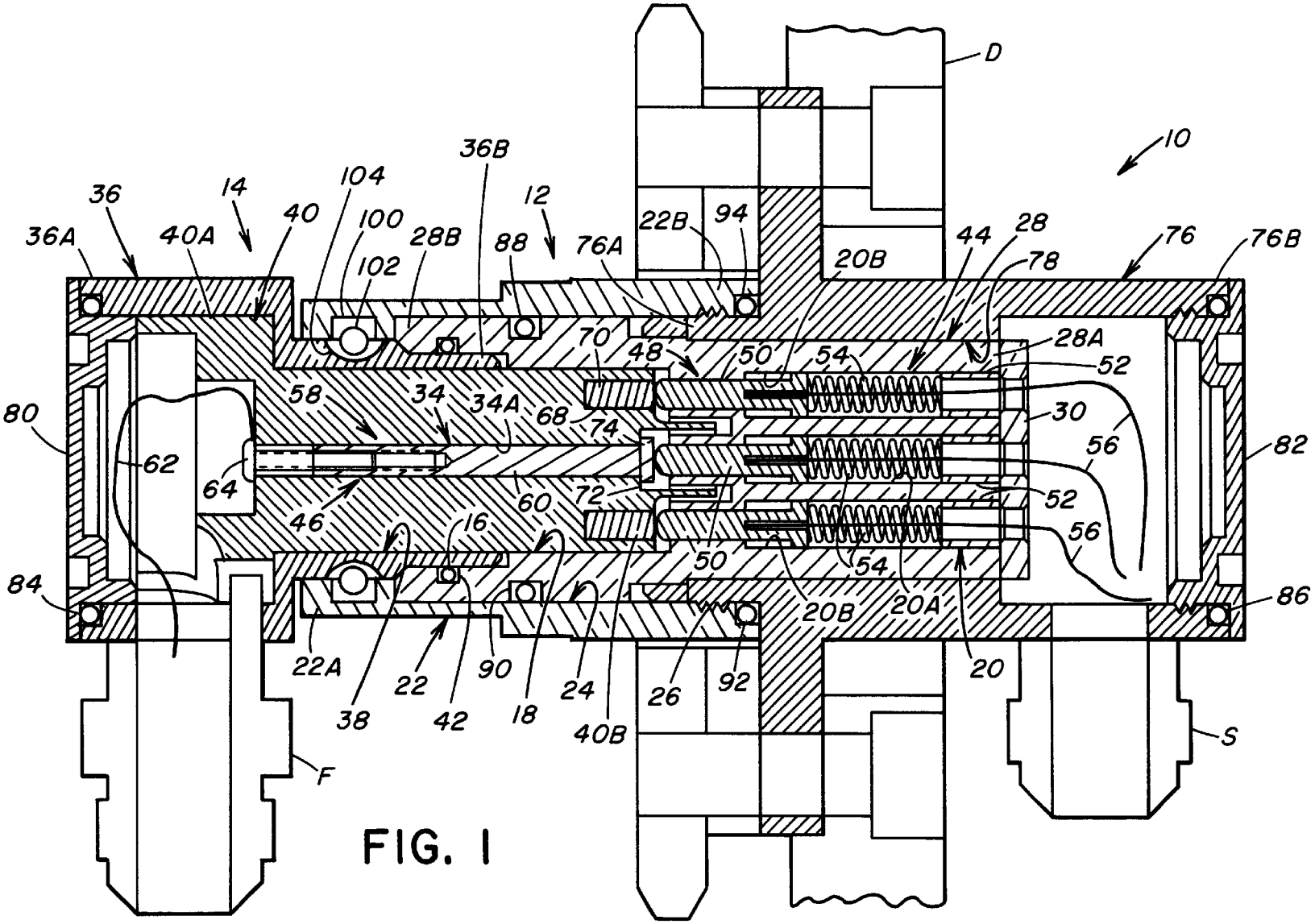
FIG. 1 is a longitudinal sectional view of a waterproof quick disconnect slip ring device of the present invention.

Referring to the drawings and particularly to FIG. 1, there is illustrated a waterproof quick disconnect slip ring device, generally designated 10, of the present invention. Basically, the slip ring device 10 includes a female component 12 attachable to one of a stationary component or a rotating component, a male component 14 attachable to the other of the stationary component or the rotating components and being removably inserted into the female component 12 so as to permit relative rotation between the female and male components 12, 14 about a central longitudinal axis A through the device 10, and an annular dynamic seal 16 provided between the female and male components 12, 14 so as to provide a dynamic watertight seal therebetween as the female and male components 12, 14 undergo relative rotation about the central longitudinal axis A. For example, the female component 12 may be attached, such as by being bolted, to a rotating part of the host system, such as a rotating winch drum D. The male component 14 may remain stationary, being attached to a stationary part, such as the fitting F of an underwater cable. The female and male components 12, 14 are removably interfitted together such that they attach to one another and come apart from one another in quick disconnect fashion that allows the female component 12 to be free to rotate relative to the male component 14 about the central longitudinal axis A.

Figure 2:
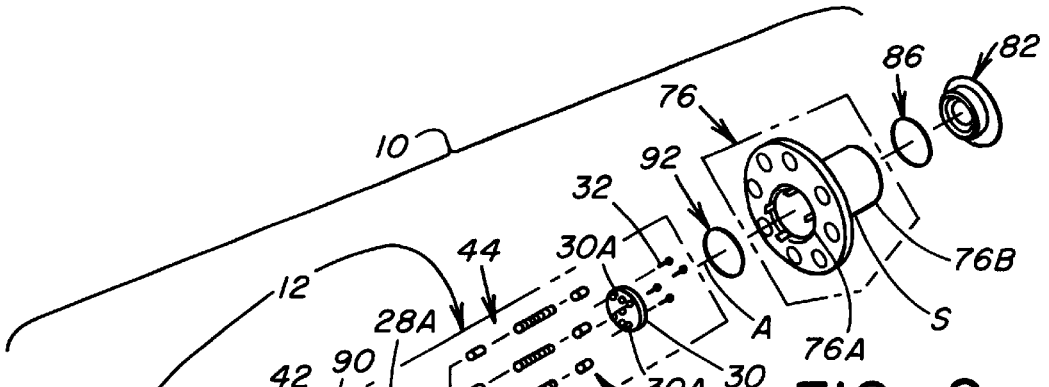
FIG. 2 is an exploded perspective view of a female component of the slip ring device shown in FIG. 1.
Figure 3:
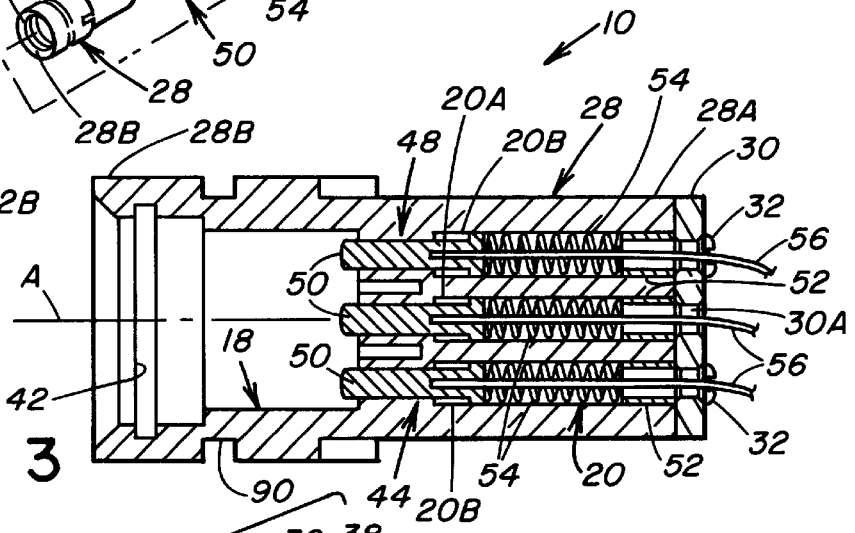
FIG. 3 is an assembled longitudinal sectional view of a female insulator member of the female component shown in FIG. 2.

Referring to FIGS. 1—3, the female component 12 of the slip ring device 10 has a pair of spaced apart opposite end portions, a cavity 18 extending therein from one end portion, and a plurality of longitudinal passageways 20 laterally spaced apart and extending therein from the other end portion and merging into the cavity 18. More particularly, the female component 12 includes an elongated female connector member 22 preferably although not necessarily of a cylindrical shape and having spaced apart opposite first and second ends 22A, 22B and a longitudinal bore 24 extending between the first and second ends 22A, 22B. The female connector member 22 at its second end 22B has means in the form of internal threads 26 for attaching the female connector member 22 to the one of the stationary and rotating components as will be described later. The female component 12 also includes an elongated female insulator member 28 preferably although not necessarily of a cylindrical shape and being disposed in a close fitting non-rotatable relationship with the female connector member 22. The female insulator member 28 has spaced apart opposite outer and inner ends 28A, 28B and the cavity 18 defined from the inner end 28B into the female insulator member 28 to intermediately between the outer and inner ends 28A, 28B, and the plurality of laterally spaced apart longitudinal passageways 20 extending from the outer end 28A and merging into the cavity 18. The female insulator member 28 at its inner end 28B is inserted through the longitudinal bore 24 of the female connector member 22 from the second end 22B to adjacent to the first end 22A thereof such that the inner end 28B of the female insulator member 28 is disposed within the female connector member 22 adjacent to the first end 22A thereof and the outer end 28A of the female insulator member 28A protrudes through a substantial length from and beyond the second end 22B of the female connector member 22. A perforated end plate 30 is attached by screws 32 to the outer end 28A of the female insulator member 28.

Figure 4:
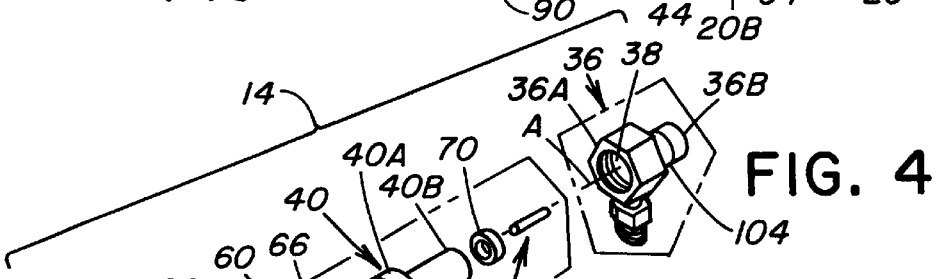
FIG. 4 is an exploded perspective view of a male component of the slip ring device shown in FIG. 1.
Figure 5:
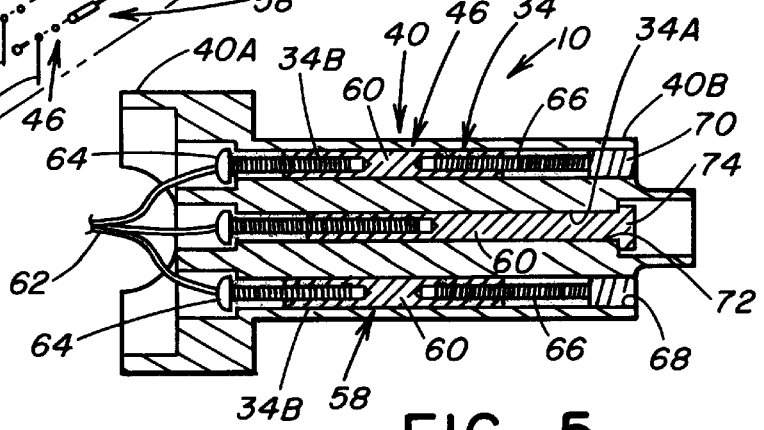
FIG. 5 is an assembled longitudinal sectional view of a male insulator member of the male component shown in FIG. 4.

Referring to FIGS. 1, 4 and 5, the male component 14 of the slip ring device 10 has a pair of spaced apart opposite end portions and a plurality of laterally spaced apart longitudinal channels 34 extending between the opposite end portions. More particularly, the male component 14 includes an elongated male connector member 36 preferably although not necessarily of cylindrical shape and having spaced apart opposite outer and inner ends 36A, 36B and a longitudinal passage 38 extending between the outer and inner ends 36A, 36B. The male connector member 36 at its outer end 36A has means in the form of the fitting F for attaching the male connector member 36 to the other of said stationary and rotating components. The male component 14 also includes an elongated male insulator member 40 disposed in a close fitting non-rotatable relationship with the male connector member 36 and having spaced apart opposite first and second ends 40A, 40B. The male insulator member 40 at its second end 40B is inserted through the longitudinal passage 38 of the male connector member 36 from its outer end 36A to beyond its inner end 36B such that the first end 40A of the male insulator member 40 is disposed within the outer end 36A of the male connector member 36 while the second end 40B of the male insulator member 40 protrudes substantially from and beyond the inner end 36B of the male connector member 36. The male connector member 36 at its inner end 36B and the male insulator member 40 at its second end 40B are respectively removably inserted into the bore 24 and cavity 18 of and rotatable relative to the female connector member 22 at its first end 22A and the female insulator member 28 at its inner end 28B. The annular dynamic seal 16 provided between the inner end 28B of the female insulator member 28 and the inner end 36B of the male connector member 36 preferably takes the form of a rubber O-ring seal 16 seated in an annular groove 42 defined in the inner end 20B of the female insulator member 28 which in such place provides a dynamic water-tight seal therebetween as the female and male components 12, 14 undergo relative rotation.

Referring now to FIGS. 1–5, the slip ring device 10 further includes first and second electrical conductor arrangements 44, 46 disposed respectively in the female and male insulator members 28, 40 and electrically coupled to one another so as to provide electrical circuit paths through the slip ring device 10 regardless of the relative rotational positions of the female and male components 12, 14 with respective to one another as they and the first and second electrical conductor arrangements 44, 46 therewith undergo rotation relative to one another about the central longitudinal axis A. More particularly, the first electrical conductor arrangement 44 of the female component 12 includes a plurality of first electrical conductor elements 48 each disposed in one of the longitudinal passageways 20 in the female insulator member 28 and extending therefrom at least a short distance into the cavity 18 of the female insulator member 28. Each of the first electrical conductor elements 48 includes an inner conductive pin 50, an outer annular spacer 52 disposed adjacent to the end plate 30, a coil spring 54 disposed between the inner pin 50 and outer spacer 52, and a conductor wire 56 soldered at one end to the conductive pin 50 and extending therefrom through the coil spring 54, spacer 52 and one of the holes 30A in the end plate 30. The second electrical conductor arrangement 46 of the male component 14 includes a plurality of second electrical conductor elements 58 each disposed in one of the longitudinal channels 34 of the male insulator member 40. Each of the second electrical conductor elements 58 includes a conductive standoff pin 60, a conductor wire 62 secured to the standoff pin 60 by a screw 64 threaded into the outer end portion of the standoff pin 60, and a threaded inner stem 66 fitted to and extending from the inner end portion of the standoff pin 60. All of the conductor wires 62 are routed out from the male component 14 through an opening in the fitting F.

The plurality of longitudinal passageways 20 in the female insulator member 28 includes at least one central longitudinal passageway 20A extending along the central longitudinal axis A of the slip ring device 10 and at least a pair of lateral longitudinal passageways 20B displaced laterally the same distance from and extending parallel to the central longitudinal passageway 20A. The plurality of longitudinal channels 34 in the male insulator member 40 includes at least one central longitudinal channel 34A extending along the central longitudinal axis A of the slip ring device 10 and at least a pair of lateral longitudinal channels 34B displaced laterally the same distance from and extending parallel to the central longitudinal channel 34A. The central longitudinal passageway and channel 20A, 34A are aligned with one another along the central longitudinal axis A of the slip ring device A and the lateral longitudinal passageways and channels 20B, 34B are displaced substantially the same distance from the central longitudinal axis A.

Referring to FIGS. 1 and 4, the second electrical conductor arrangement 46 in the male insulator member 40 further includes means for electrically coupling the first and second electrical conductor elements 48, 58 of the female and male components 12, 14 to one another. Such electrical coupling means includes an annular recess 68 defined in the second end 40B of the male insulator member 40 and an annular electrical contact element 70 in the form of a ring disposed in the annular recess 60. The annular recess 60 is aligned and merges with the lateral longitudinal channels 34B in the male insulator member 40 and is aligned with the lateral longitudinal passageways 20B in the female insulator member 28. The annular electrical contact element 70 provides the electrical coupling between the lateral ones of the second electrical conductor elements 58 in the lateral longitudinal channels 34B of the male insulator member 40 and the lateral ones of the first electrical conductor elements 48 in the lateral longitudinal passageways 20B of the female insulator member 28. This establishes a first electrical circuit path through the slip ring device 10.

The electrical coupling means further includes a central recess 72 defined in the second end 40B of the male insulator member 40 and a central electrical contact element 74 disposed in the central recess 72. The central recess 72 provides an extension of the central longitudinal channel 34A in the male insulator member 40 and is aligned with the central longitudinal passageway 20A in the female insulator member 28. The central electrical contact element 74 is attached to and provides an extension of the central one of the second electrical conductor elements 58 in the central longitudinal channel 34A of the male insulator member 40 and thereby provides the electrical coupling between the central one of the second electrical conductor elements 58 of the male insulator member 40 and a central one of the first electrical conductor elements 48 of the female insulator member 28. This establishes a second electrical circuit path through the slip ring device 10.

Also, the first electrical conductor elements 48 of the female insulator member 28 respectively extend from its longitudinal passageways 20 at least for a short distance into the cavity 18 of the female insulator member 28. As described above, the first electrical conductor elements 48 are spring-mounted to the female insulator member 28 so as to be retractable away from the cavity 18 upon insertion of the male insulator member 40 in the cavity 18 of the female insulator member 28 and upon engagement of the first electrical conductor elements 48 in the female insulator member 28 with the annular and central electrical contact elements 70, 74 of the male insulator member 40. Such extension of the first conductor members 48 into the cavity 18 and spring mounting thereof to the female insulator member 28 imposes a biasing force on the first conductor members 48 which ensures that good electrical continuity is maintained with the annular and central contact elements 70, 74.

Referring to FIGS. 1 and 2, the slip ring device 10 further includes an annular hub 76 having a pair of spaced apart opposite inner and outer end portions 76A, 76B and a longitudinal opening 78 extending therebetween with the female component 12 being removably inserted in and secured to the annular hub 76. The female connector member 22 at its second end 22B has internal threads 26 by which the female component 12 is removably secured to external threads 80 on the inner end portion 76A of the annular hub 76. After the female insulator member 28 is inserted into the longitudinal bore 24 of the female connector member 22 from its second end 22B, the annular hub 76 can be applied over the portion of the female insulator member 28 that protrudes from and beyond the second end 22B of the female connector member 22 and then the annular hub 76 is threaded into the female connector member 22. The conductor wires 28D of the female component 12 are routed from the female insulator member 28 through the interior of the annular hub 76 and out through a side fitting S in the annular hub 76. The annular hub 76, in turn, is secured to the rotating component, such as the drum D, in any suitable manner.

Referring to FIGS. 1, 2 and 4, the slip ring device 10 also includes a pair of end caps 80, 82 and a pair of annular static seals 84, 86 in the form of rubber O-ring seals. The end caps 80, 82 and annular static seals 84, 86 are applied respectively to the outer end 36A of the male connector member 36 and the outer end portion 76B of the annular hub 76 so as to provide water-tight static seals at opposite outer ends of the slip ring device 10. Two more static seals are provided in the slip ring device 10: one annular static seal 88 is provided in an annular external groove 90 in the female insulator member 28 between it and the female connector member 22; and the other annular static seal 92 is provided in another annular interior groove 94 in the second end 22B of the female connector member 22 between it and the inner end portion 76A of the annular hub 76 adjacent to the threaded connection therebetween. Also, it is preferred that an annular bushing 96 be press fitted into an annular lip 98 in the first end 22A of the female connector member 22 to assist in minimizing the slack in the connection between the female and male components 12, 14. Although other insulating materials could be used, one plastic material known as Acetal has been used to make the bushing 96, the female and male insulator members 28, 40, the end plate 30 and the three spacers 52. This plastic material is an engineering plastic offering greater wear and strength resistance than other insulating plastics and it is easy to machine.

On the female component 12 an expandable ring 100 is provided circumferentially around the interior of the first end 22A of the female connector member 22 which holds a series of ball bearings 102 as seen in FIGS. 1 and 2, while on the male component 14 an exterior annular groove 96 is formed circumferentially around the exterior of the male connector member 36 intermediately between the outer and inner ends 36A, 36B thereof as seen in FIGS. 1 and 3. To release the male component 14 from the female component 12 of the slip ring device 10, the male component 14 is merely pulled away from the female component 12 with sufficient force to expand the ring 100 and retract the ball bearings 102 from the groove 104. To reconnect or install the male component 14 to the female component 12 the operation is reversed. The male component 14 is pushed into the female component 12 with sufficient force to expand the ring 100 and allow the ball bearings 104 to re-seat into the groove 104.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. A waterproof quick disconnect slip ring device, comprising:

(a) a female component having means for attaching said female component to one of stationary and rotating components, said female component also having a pair of spaced apart opposite ends, a cavity extending therein from one of said ends and a plurality of longitudinal passageways laterally spaced apart and extending therein from the other of said ends and merging into said cavity;

(b) a plurality of first electrical conductor elements each disposed in one of said longitudinal passageways of said female component;

(c) a male component having means for attaching said male component to the other of stationary and rotating components and being removably inserted into said cavity of said female component so as to permit relative rotation therebetween about a central longitudinal axis through said female and male components, said male component further having a pair of spaced apart opposite ends and a plurality of laterally spaced apart longitudinal channels defined between said opposite ends;

(d) a plurality of second electrical conductor elements each disposed in one of said longitudinal channels of said male component;

(e) means in said male and female components for electrically coupling said first electrical conductor elements of said female component with said second electrical conductor elements of said male component to provide electrical circuit paths through said slip ring device regardless of relative rotational positions of said female and male components with respect to one another as said female and male components and said first and second electrical conductor elements therewith undergo rotation relative to one another, said electrical coupling means including (i) an annular recess defined in said male component at one of said end portions thereof and being aligned and merging with said longitudinal channels in said male component and aligned with said longitudinal passageways in said female component, and (ii) an annular electrical contact element disposed in said annular recess of said male component so as to provide electrical coupling of lateral ones of said second electrical conductor elements disposed in said longitudinal channels of said male component with lateral ones of said first electrical conductor elements disposed in said longitudinal passageways of said female component; and (f) an annular dynamic seal provided between said female and male components so as to provide a dynamic water-tight seal therebetween as said female and male components undergo relative rotation.

2. The slip ring device of claim 1 further comprising:

an annular hub having a pair of spaced apart opposite end portions and a longitudinal opening extending therebetween, said female component being removably inserted into said longitudinal opening of and secured to said annular hub.

3. The slip ring device of claim 1 further comprising:

a pair of end caps; and a pair of annular static seals each applied to one of said end caps;

said end caps with said annular static seals being respectively applied to outer ones of said end portions of said male component and annular hub so as to provide water-tight static seals at opposite ends of the slip ring device.

4. The slip ring device of claim 1 wherein said female component includes an elongated female connector member having spaced apart opposite first and second ends and a longitudinal bore extending between said first and second ends, said female connector member at said second end thereof having said means for attaching said female connector member to said one of said stationary and rotating components.

5. The slip ring device of claim 4 wherein said female component further includes an elongated female insulator member disposed in a close fitting non-rotatable relationship with said female connector member and having spaced apart opposite outer and inner ends and said cavity defined from said inner end into said female insulator member to intermediately between said outer and inner ends, said female insulator member at said inner end being inserted through said longitudinal bore of said female connector member from said second end to adjacent to said first end thereof such that said inner end of said female insulator member is disposed within said female connector member adjacent to said first end thereof and said outer end of said female insulator member protrudes from and beyond said second end of said female connector member.

6. The slip ring device of claim 5 further comprising:

an annular hub having a pair of spaced apart opposite end portions and a longitudinal opening extending therebetween, said female connector member at said second end thereof being removably secured to said annular hub at said one of said opposite end portions thereof, said female insulator member at said outer end thereof protruding from and beyond said second end of said female connector member being inserted through said longitudinal opening of said annular hub.

7. The slip ring device of claim 6 wherein said male component includes an elongated male connector member having spaced apart opposite outer and inner ends and a longitudinal passage extending between said outer and inner ends of said male connector member, said male connector member at said outer end thereof having said means for attaching said male connector member to said other of said stationary and rotating components.

8. The slip ring device of claim 7 wherein said male component further includes an elongated male insulator member disposed in a close fitting non-rotatable relationship with said male connector member and having spaced apart opposite first and second ends, said male insulator member at said second end thereof being inserted through said longitudinal passage of said male connector member from said outer end to beyond said inner end thereof such that said first end of said male insulator member is disposed within said male connector member adjacent to said outer end thereof and said second end of said male insulator member protrudes from and beyond said inner end of said male connector member, said male connector member at said inner end thereof and said male insulator member at said second end thereof also being respectively removably inserted into said bore and cavity of and rotatable relative to said female connector member at said first end thereof and said female insulator member at said inner end thereof.

9. The slip ring device of claim 1 wherein:

said plurality of longitudinal passageways of said female component includes at least one central longitudinal passageway extending along said central longitudinal axis and at least a pair of lateral longitudinal passageways displaced laterally the same distance from and extending parallel to said central longitudinal passageway; and said plurality of longitudinal channels of said male component includes at least one central longitudinal channel extending along said central longitudinal axis and at least a pair of lateral longitudinal channels displaced laterally the same distance from and extending parallel to said central longitudinal channel, said central longitudinal passageway and channel being aligned with one another, said lateral longitudinal passageways and channels being displaced the same distance from said central longitudinal axis.

10. The slip ring device of claim 9 wherein said electrical coupling means further includes:

a central recess defined in said male component at said one end portion thereof, said central recess providing an extension of said central longitudinal channel in said male component and being aligned with said central longitudinal passageway in said female component; and a central electrical contact element disposed in said central recess of said male component, said central electrical contact element being attached to and providing an extension of a central one of said second electrical conductor elements disposed in said central longitudinal channel of said male component to provide electrical coupling of said central one of said second electrical conductor elements of said male component with a central one of said first electrical conductor elements of said female component.

11. The slip ring device of claim 10 wherein said first electrical conductor elements of said female component respectively extend from said longitudinal passageways thereof at least for a short distance into said cavity thereof and are spring-mounted to said female component so as to be retractable away from said cavity upon insertion of said male component in said cavity of said female component and upon engagement of said first electrical conductor elements of the female component with said annular and central electrical contact elements of said male component.

12. A waterproof quick disconnect slip ring device, comprising:

(a) a female component adapted for mounting to one of stationary and rotating components, said female component including (i) an elongated female connector member having spaced apart opposite first and second ends and a longitudinal bore extending between said first and second ends, said female connector member at said second end thereof having means for attaching said female connector member to said one of said stationary and rotating components, (ii) an elongated female insulator member disposed in a close fitting non-rotatable relationship with said female connector member and having spaced apart opposite outer and inner ends and a cavity defined from said inner end into said female insulator member to intermediately between said outer and inner ends, said female insulator member at said inner end being inserted through said longitudinal bore of said female connector member from said second end to adjacent to said first end thereof such that said inner end of said female insulator member is disposed within said female connector member adjacent to said first end thereof and said outer end of said female insulator member protrudes from and beyond said second end of said female connector member, and (iii) a first electrical conductor arrangement disposed in said female insulator member and including a plurality of longitudinal passageways laterally spaced apart and extending in said female insulator member from said inner end and merging into said cavity thereof and a plurality of first electrical conductor elements each disposed in one of said longitudinal passageways;

(b) a male component adapted for mounting to the other of stationary and rotating components and being insertable into said female component so as to permit removal therefrom and relative rotation therebetween, said male component including (i) an elongated male connector member having spaced apart opposite outer and inner ends and a longitudinal passage extending between said outer and inner ends of said male connector member, said male connector member at said outer end thereof having means for attaching said male connector member to the other of said stationary and rotating components, (ii) an elongated male insulator member disposed in a close fitting non-rotatable relationship with said male connector member and having spaced apart opposite first and second ends, said male insulator member at said second end thereof being inserted through said longitudinal passage of said male connector member from said outer end to beyond said inner end thereof such that said first end of said male insulator member is disposed within said male connector member adjacent to said outer end thereof and said second end of said male insulator member protrudes from and beyond said inner end of said male connector member, said male connector member at said inner end thereof and said male insulator member at said second thereof also being respectively removably inserted into said bore and cavity of and rotatable relative to said female connector member at said first end thereof and said female insulator member at said inner end thereof, and (iii) a second electrical conductor arrangement disposed in said male insulator member and electrically coupled with said first electrical conductor arrangement in said female insulator member of said female component to provide electrical circuit paths through said slip ring device regardless of relative rotational positions of said female and male components with respect to one another as said female and male components and said first and second electrical conductor arrangements therewith undergo rotation relative to one another, said second electrical conductor arrangement including a plurality of longitudinal channels laterally spaced apart and extending in said male insulator member between said first and second ends thereof, a plurality of second electrical conductor elements each disposed in one of said longitudinal channels, an annular recess defined in said male insulator member at said second end thereof and being aligned and merging with said longitudinal channels and aligned with said longitudinal passageways of said first electrical conductor arrangement in said female insulator member, and an annular electrical contact element disposed in said annular recess in said male insulator member so as to provide electrical coupling of lateral ones of said second electrical conductor elements disposed in said longitudinal channels in said male insulator member with lateral ones of said first electrical conductor elements disposed in said longitudinal passageways in said female insulator member; and (c) an annular dynamic seal provided between said inner end of said female insulator member of said female component and said inner end of said male connector member of said male component so as to provide a dynamic water-tight seal therebetween as said female and male components undergo relative rotation.

13. The slip ring device of claim 12 further comprising:

an annular static seal provided between said female connector member and said female insulator member.

14. The slip ring device of claim 12 further comprising:

an annular hub having a pair of spaced apart opposite end portions and a longitudinal opening extending therebetween, said female connector member at said second end thereof being removably secured to said annular hub at said one of said opposite end portions thereof, said female insulator member at said outer end thereof protruding from and beyond said second end of said female connector member being inserted through said longitudinal opening of said annular hub.

15. The slip ring device of claim 14 further comprising:

an annular static seal provided between said second end of said female connector member and said one end portion of said annular hub.

16. The slip ring device of claim 14 further comprising:

a pair of end caps; and a pair of annular static seals each applied to one of said end caps;

said end caps with said annular static seals being respectively applied to said outer end of said male connector member and the other of end portions of said annular hub so as to provide water-tight seals at outer opposite ends of the slip ring device.

17. The slip ring device of claim 12 wherein:

said plurality of longitudinal passageways of said female insulator member includes at least one central longitudinal passageway extending along said central longitudinal axis and at least a pair of lateral longitudinal passageways displaced laterally the same distance from and extending parallel to said central longitudinal passageway; and said plurality of longitudinal channels of said male insulator member includes at least one central longitudinal channel extending along said central longitudinal axis and at least a pair of lateral longitudinal channels displaced laterally the same distance from and extending parallel to said central longitudinal channel, said central longitudinal passageway and channel being aligned with one another, said lateral longitudinal passageways and channels being displaced the same distance from said central longitudinal axis.

18. The slip ring device of claim 17 wherein said second electrical conductor arrangement further includes:

a central recess defined in said male insulator member at said second end thereof, said central recess providing an extension of said central longitudinal channel in said male insulator and being aligned with said central longitudinal passageway in said female insulator member; and a central electrical contact element disposed in said central recess of said male insulator member, said central electrical contact element being attached to and providing an extension of a central one of said second electrical conductor elements disposed in said central longitudinal channel of said male insulator member to provide electrical coupling of said central one of said second electrical conductor elements of said male insulator member with a central one of said first electrical conductor elements of said female insulator member.

19. The slip ring device of claim 18 wherein said first electrical conductor elements of said female insulator member respectively extend from said longitudinal passageways thereof at least for a short distance into said cavity thereof and are spring-mounted to said female insulator member so as to be retractable away from said cavity upon insertion of said male insulator member in said cavity of said female insulator member and upon engagement of said first electrical conductor elements of the female insulator member with said annular and central electrical contact elements of said male insulator member.

* * * * *